US009140045B1

(12) United States Patent
Finkelstein et al.

(10) Patent No.: US 9,140,045 B1
(45) Date of Patent: Sep. 22, 2015

(54) OFFSET ADJUSTABLE HINGE

(71) Applicant: Kason Industries, Inc., Newnan, GA (US)

(72) Inventors: Burl M. Finkelstein, Newnan, GA (US); Brett A. Mitchell, Newnan, GA (US); Jeffrey E. Underwood, Newnan, GA (US)

(73) Assignee: Kason Industries, Inc., Newnan, GA (US)

( * ) Notice: Subject to any disclaimer, the term of this patent is extended or adjusted under 35 U.S.C. 154(b) by 0 days.

(21) Appl. No.: 14/272,175

(22) Filed: May 7, 2014

(51) Int. Cl.
*E05D 7/04* (2006.01)
*F25D 23/02* (2006.01)

(52) U.S. Cl.
CPC ..... *E05D 7/04* (2013.01); *E05Y 2900/306* (2013.01); *E05Y 2900/31* (2013.01); *F25D 23/028* (2013.01); *Y10T 16/532* (2015.01); *Y10T 16/5398* (2015.01)

(58) Field of Classification Search
CPC ..... Y10T 16/532; Y10T 16/5324; Y10T 16/53247; Y10T 16/5327; Y10T 16/5387; Y10T 16/539; Y10T 16/5393; Y10T 16/5398; Y10T 16/53988; Y10T 16/53996; Y10T 16/540255; E05D 3/022; E05D 7/0009; E05D 7/0018; E05D 7/0045; E05D 7/04; E05D 7/0415; E05D 2007/0484; E05D 11/1078; E05F 1/063; E05Y 2900/31; E05Y 2900/306; F25D 23/028
USPC ..... 16/235, 242, 243, 248, 303, 309, 310, 16/312, 316, 318, 330; 312/326, 405; 49/239, 386
See application file for complete search history.

(56) References Cited

U.S. PATENT DOCUMENTS

| | | | | | |
|---|---|---|---|---|---|
| 1,392,049 | A * | 9/1921 | Dicken | ..... | 16/239 |
| 2,039,774 | A * | 5/1936 | Bryson | ..... | 16/238 |
| 3,262,204 | A | 12/1966 | Tansey | | |
| 3,733,650 | A | 5/1973 | Douglas | | |
| 3,879,801 | A * | 4/1975 | Rashid et al. | ..... | 16/249 |
| 4,631,777 | A * | 12/1986 | Takimoto | ..... | 16/315 |
| D395,590 | S | 6/1998 | Finkelstein et al. | | |
| D401,134 | S | 11/1998 | Finkelstein | | |
| 5,970,819 | A | 10/1999 | Katoh | | |
| 6,374,458 | B1 | 4/2002 | Finkelstein | | |
| 6,862,779 | B1 | 3/2005 | Lu et al. | | |
| 7,055,214 | B1 | 6/2006 | Finkelstein | | |
| 7,509,709 | B2 | 3/2009 | Chung | | |
| 7,526,894 | B2 | 5/2009 | Falato et al. | | |
| 7,555,815 | B2 * | 7/2009 | Tate et al. | ..... | 16/309 |
| 7,584,523 | B1 | 9/2009 | Finkelstein et al. | | |
| 7,870,642 | B1 | 1/2011 | Finkelstein et al. | | |
| D637,060 | S | 5/2011 | Mitchell et al. | | |

(Continued)

*Primary Examiner* — William Miller
(74) *Attorney, Agent, or Firm* — Baker Donelson; Dorian B. Kennedy

(57) ABSTRACT

There is disclosed a hinge (10) which includes a mounting flange assembly (12) pivotally coupled to a strap assembly (15). The mounting flange assembly has a lower hinge flange (18) which includes a cam recess (19) having multiple pivot pin mounting holes (25). A cam follower (30) mounted to the mounting flange assembly includes a cam portion (35), seating plate (34) configured to nest within the flange recess, and a mounting post (38). A pivot pin channel (44) extends through the seating plate. A pivot pin (45) is mounted to one of the three pivot pin mounting holes depending upon the desired offset of the strap assembly. The hinge includes three different cam followers each having a unique configuration and positioning of the cam portion, cam follower mounting post, and position of the pivot pin channel.

16 Claims, 3 Drawing Sheets

(56) References Cited

U.S. PATENT DOCUMENTS

| | | | | |
|---|---|---|---|---|
| 7,945,996 | B2 * | 5/2011 | Gunderson | 16/312 |
| D645,725 | S | 9/2011 | Katz et al. | |
| 8,020,253 | B1 | 9/2011 | Finkelstein et al. | |
| D658,031 | S | 4/2012 | Mitchell et al. | |
| 8,166,612 | B2 * | 5/2012 | Bertolini et al. | 16/244 |
| 8,407,859 | B1 | 4/2013 | Mitchell et al. | |
| 8,505,166 | B2 | 8/2013 | Mitchell et al. | |
| 8,621,715 | B2 | 1/2014 | Mitchell et al. | |
| 8,800,109 | B1 | 8/2014 | Mitchell et al. | |
| 2013/0067687 | A1 * | 3/2013 | Mitchell et al. | 16/312 |
| 2013/0305488 | A1 * | 11/2013 | Dodge et al. | 16/245 |
| 2014/0215759 | A1 * | 8/2014 | Mitchell et al. | 16/235 |
| 2014/0215760 | A1 | 8/2014 | Mitchell et al. | |
| 2014/0215762 | A1 | 8/2014 | Mitchell et al. | |
| 2014/0215923 | A1 * | 8/2014 | Gompper | 49/381 |
| 2014/0259529 | A1 * | 9/2014 | Jenkinson | 16/248 |

* cited by examiner

OFFSET ADJUSTABLE HINGE

TECHNICAL FIELD

This invention relates generally to door hinges, and more particularly to offset adjustable hinges used for commercial refrigerator and freezer doors.

BACKGROUND OF INVENTION

Walk-in cold rooms, such as walk-in coolers, freezers, or other refrigerated environments, are common in various industries, including supermarkets and grocery stores, commercial kitchens, and other food service facilities. These cold rooms typically have one or more access doors for entry and exit.

A problem associated with the mounting of these types of doors is that their thicknesses may vary. As such, the hinges that mount the door to the door jamb may have different offsets to accommodate for the different sized doors, the offset being the distance between the outside of the door and the outside of the door jamb. This problem requires that a manufacturer design and produce several offset sized hinges which increases the cost of manufacturing.

Accordingly, there is a need in the art for a hinge that will allow for differently sized doors to be mounted utilizing the properly offset sized hinge to insure proper closing and sealing of the door against the door jamb. It is to the provision of such therefore that the present invention is primarily directed.

SUMMARY OF THE INVENTION

In a preferred form of the invention an offset adjustable hinge comprises a mounting flange assembly having a mounting plate and a flange extending from the mounting plate. The flange has a top surface, a cam recess extending from the top surface, and a plurality of pivot pin mounting holes extending into the flange from the cam recess. The hinge also includes a strap assembly and a cam assembly pivotally coupling the strap assembly to the mounting flange assembly. The cam assembly includes a pivot pin configured to be mounted within one pivot pin mounting hole, a cam follower configured to be received within the cam recess, and a cam coupled to the strap assembly and configured to engage the cam follower. With this construction, the offset of the hinge is determined by which pivot pin mounting hole within which the pivot pin is positioned.

DETAILED DESCRIPTION

Figure 1:
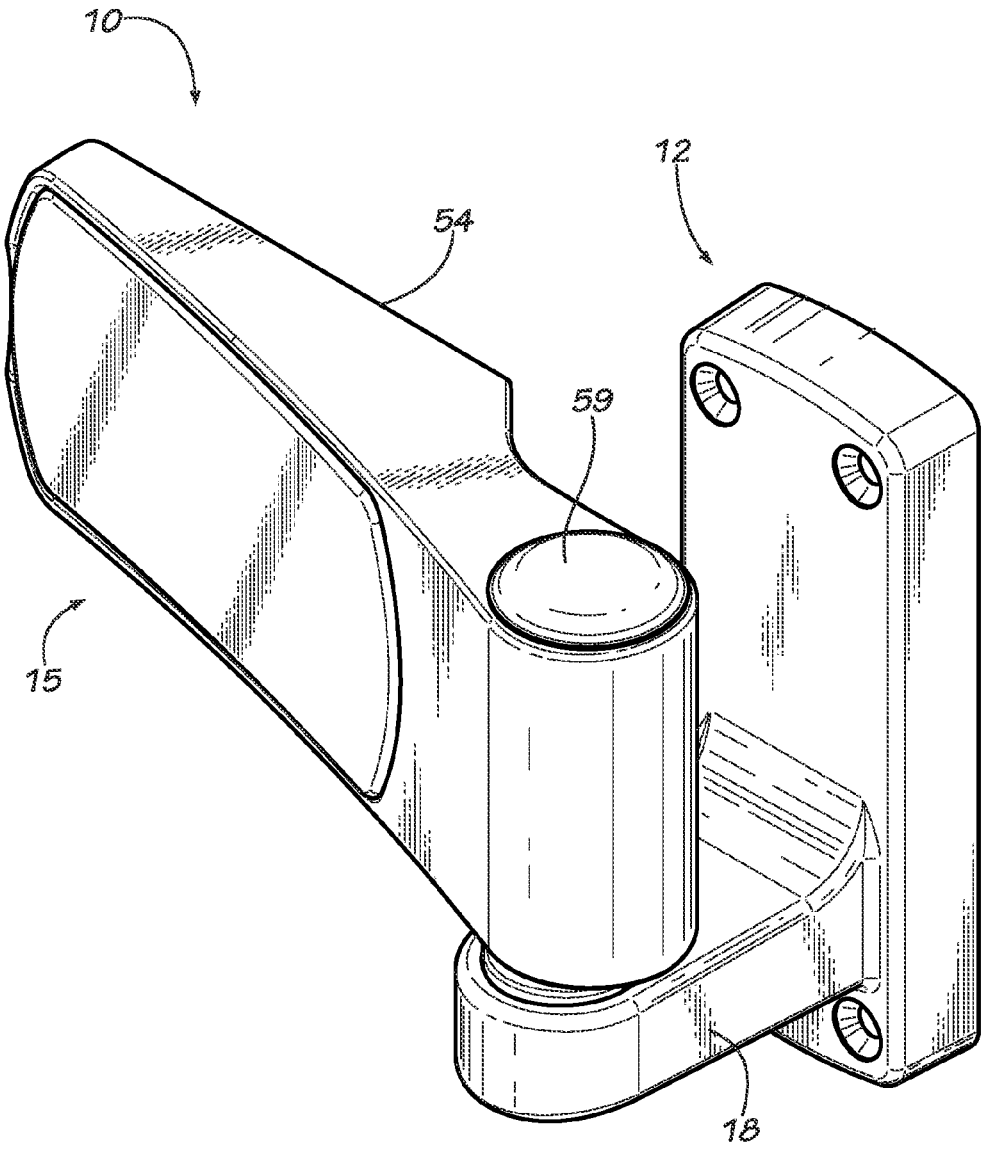
FIG. 1 is a perspective view of an offset adjustable hinge embodying principles of the invention in a preferred form.
Figure 2:
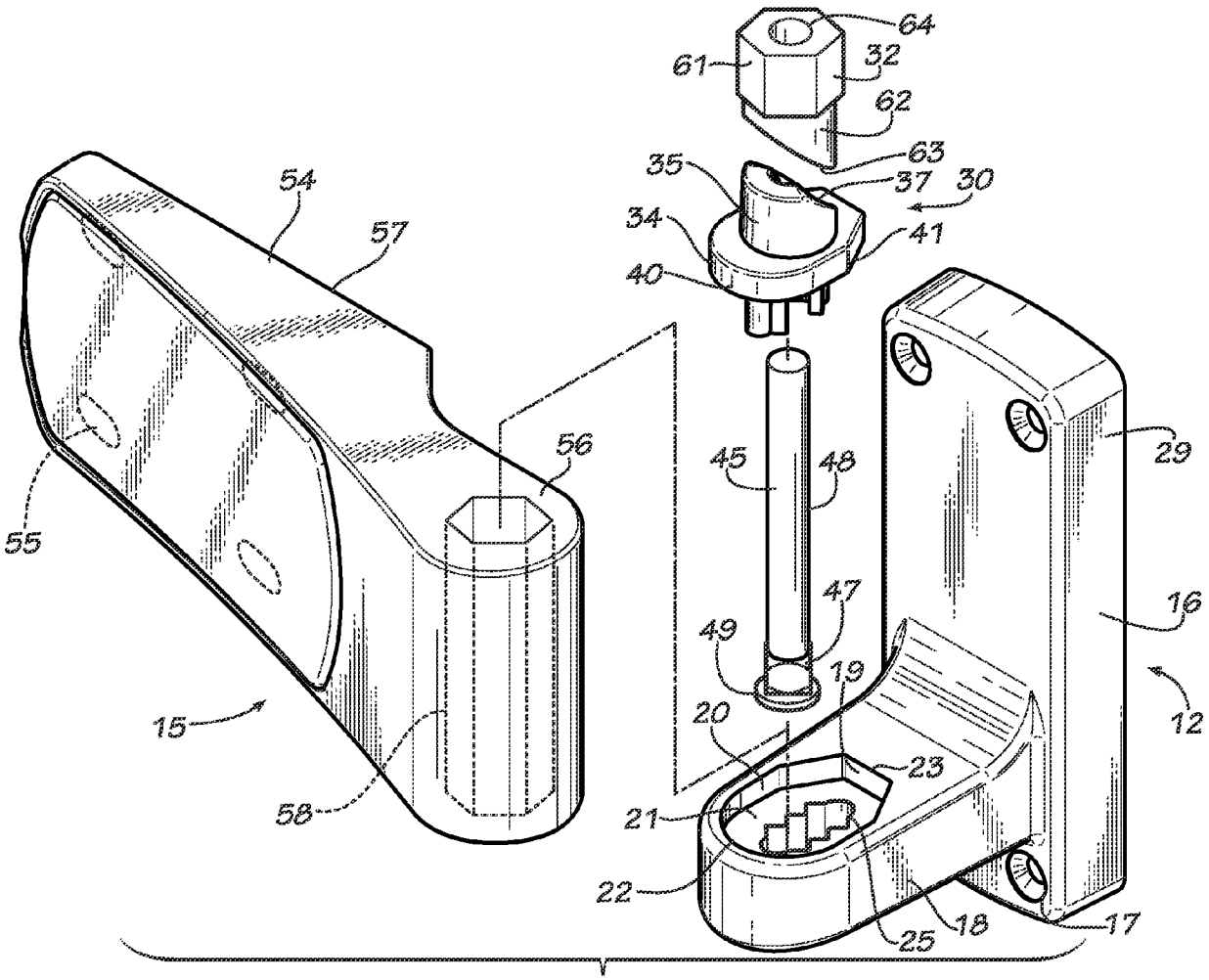
FIG. 2 is an exploded, perspective view of the offset adjustable hinge of FIG. 1.

With reference next to the drawings, there is shown a lift-off type adjustable offset hinge 10 according to the present invention. The hinge 10 includes a mounting flange assembly 12 pivotally coupled to a strap assembly 15. It is to be appreciated that the hinge 10 shown in the drawings is configured for use with a walk-in refrigerator or freezer door. The jamb and doors are well-known in the art and need not be disclosed further herein. It is to be further appreciated that the hinge 10, either alone or in combination with another hinge in accordance with the present invention, support a door (not shown) in the usual manner.

Figure 3:
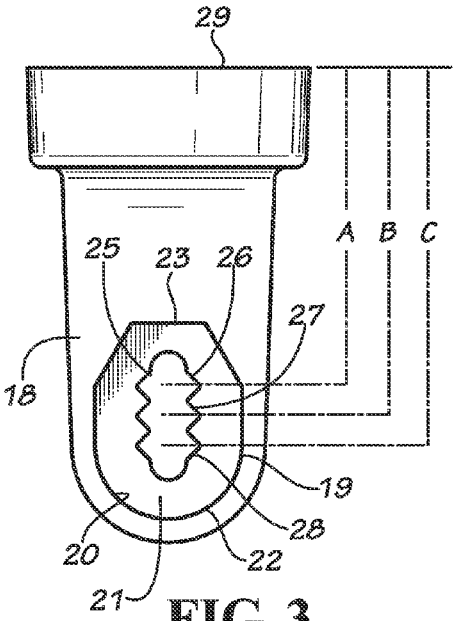
FIG. 3 is a top view of a portion of the mounting flange assembly of the offset adjustable hinge of FIG. 1.

The mounting flange assembly 12 includes a metal mounting plate 16 having four mounting holes 17 therethrough adapted to receiving unshown mounting bolts or screws, and a metal lower hinge flange 18 extending outwardly from the mounting plate 16. As used throughout the entire disclosure herein, the terms screw and bolt are used interchangeably. The lower hinge flange 18 includes a cam recess 19 defined by recess walls 20 extending from a recess floor 21. The recess walls 20 include a rounded end 22 and a flat, beveled end 23. The recess floor 21 has multiple pivot pin mounting holes 25 therethrough, shown in the preferred embodiment as three merged or contiguous mounting holes: first hole 26, second hole 27, and third hole 28 which are aligned linearly and generally perpendicularly to the mounting plate 16. Each pivot pin mounting hole 26, 27 and 28 is essentially diamond or square shaped which appears to be partially diamond shape as each mounting hole encroaches upon the space of the adjoining mounting hole. As seen in FIG. 3, the center of the first mounting hole 26 is a distance A from the far mounting surface 29 of the mounting plate 16, while second mounting hole 27 is a distance B from the far mounting surface 29 of the mounting plate 16, and the third mounting hole 28 is a distance C from the far mounting surface 29 of the mounting plate.

The cam recess 19 is configured to receive a cam assembly which has a cam follower 30 and an internally mounted cam 32 which enables the hinge to be a riser type hinge. The cam follower 30 includes a seating plate 34 configured to nest within the flange recess 19, an upwardly extending cylindrical cam portion 35 having a dual sloped camming surface 37, and a downwardly extending cam follower mounting post 38. The seating plate 34 includes a rounded end 40 and a beveled end 41 which corresponds to the shape of the recess rounding end 22 and beveled end 23 so that the seating plate 34 may be positioned easily within the recess 19 in only one position. The cam follower 30 and later described cam 32 are preferably made of a smooth, low-frictional plastic material such as nylon. A pivot pin channel 44 extends through the seating plate 34 and cylindrical cam portion 35. A pivot pin or post 45 is mounted to one of the three pivot pin mounting holes 26, 27 or 28 depending upon the desired offset of the strap assembly 15. The pivot pin 45 has a diamond shaped lower portion or seat 47 and a cylindrical upper portion 48 which is configured to be journalled within the pivot pin channel 44. The seat 47 is configured to fit snugly into any one of the three pivot pin mounting holes 26, 27 or 28 and includes a round head 49, the pivot pin 45 is mounted into the mounting hole 26, 27 or 28 by passing (press fitting) the pivot pin into the mounting hole from below the hinge flange 18 until the found head 49 abuts the hinge flange.

Figure 4:
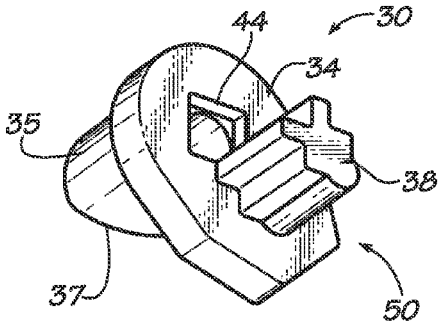
FIG. 4 is a perspective view of a first cam follower of the offset adjustable hinge of FIG. 1.
Figure 5:
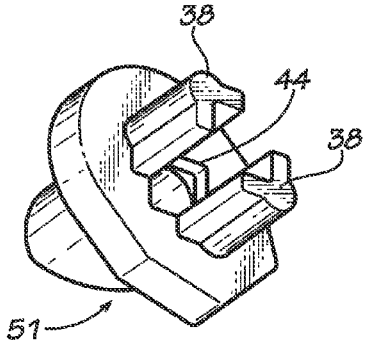
FIG. 5 is a perspective view of a second cam follower of the offset adjustable hinge of FIG. 1.
Figure 6:
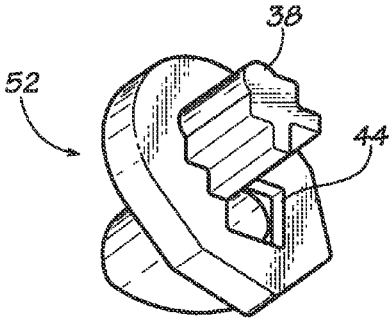
FIG. 6 is a perspective view of a third cam follower of the offset adjustable hinge of FIG. 1.

In the present invention, the hinge includes three separate and distinct cam followers 30 each having a unique configuration and positioning of the cam portion 35, cam follower mounting post 38, and pivot pin channel 44. FIG. 4 shows a first cam follower 50 having the cam portion 35, cam follower mounting post 38, and position of the pivot pin channel 44 at an outer or outboard position (aligned with third pivot pin mounting hole 28 at position C) which corresponds to the alignment with or position of the third pivot pin mounting hole 28. The cam follower mounting post 38 is configured to be received within the first and second pivot pin mounting holes 26 and 27. FIG. 5 shows a second cam follower 51 having a cam portion 35, a bifurcated cam follower mounting post 38, and position of the pivot pin channel 44 at a middle position (aligned with second pivot pin mounting hole 27 at position B) which corresponds to the alignment with or position of the second pivot pin mounting hole 27. The cam follower mounting post 38 is configured to be received within the first and third pivot pin mounting holes 26 and 28. FIG. 6 shows a third cam follower 52 having a cam portion 35, cam follower mounting post 38, and position of the pivot pin channel 44 at a inner or inboard position (aligned with first pivot pin mounting hole 26 at position A) which corresponds to the alignment with or position of the first pivot pin mounting hole 26. The cam follower mounting post 38 is configured to be received within the second and third pivot pin mounting holes 27 and 28.

The strap assembly 15 includes a metal elongated strap 54 extending from a cylinder portion 56 and having four mounting holes 55 therethrough to receive unshown mounting screws. The term cylinder portion is meant to describe the enlarged casing located at the end of the strap and the encased bearings, spring, and cam described in more detail hereinafter. The term cylinder portion is not intended to be limited to a cylinder shape, as this portion or parts of this portion may be of many known shapes and are not necessarily cylindrical in shape.

The cylindrical portion 56 includes a coupling end 57 with a vertically extending octagonal channel 58 therethrough. A cap 59 is pressed into and seals the top opening of the channel 58. The cylindrical portion 56 also houses the elongated cam 32 having an upper cam portion 61 and a lower cam portion 62. It should be noted that the coupling end octagonal channel 58 is longitudinally symmetric so that the cam 32 may be positioned in either end, thereby making it reversible (either left hand or right hand door configurable) so that the cam may fit in the octagonal channel 58 from either open end. The lower cam portion 62 also has a camming surface 63 configured to mesh or mate with the cam follower camming surface 37. The camming surface 63 includes a low point or low point area flanked on either side by symmetrical incline surfaces which terminate at a common dwell surface. The symmetry allows the cam to rise with rotation in either direction so that the hinge may be mounted to both right hand and left hand opening doors. The lower cam portion 62 has an interior channel 64 therethrough configured to receive the pivot pin 45 so that the cam 32 may rotate or pivot about the pivot pin and relative to the underlying cam follower 30.

The strap assembly 15 also includes conventionally known components, and therefore unshown, such as a compression spring positioned concentrically about the pivot pin and within cam channel. A bushing and washer, positioned on top of the bushing, are also positioned concentrically about the pivot pin and within the cam interior channel, the top end of the pivot pin being deformed to permanently attach these components together. The compression of the spring biases the cam 32 to its lowermost position, which will correlate with the closed position of the refrigerator door or an over-closure position past the closed position of the refrigerator door, and as such the hinge shown in the drawings is a self-closing type hinge.

In use, the hinge 10 is mounted to the refrigerator or freezer door in the conventional manner as is well known in the art. The mounting plate 16 is secured to the jamb by the use of screws (not shown) that extend through the mounting plate mounting holes 17 and into the jamb. A conventional walk-in refrigerator or freezer door is similarly secured to the hinge 10 by four screws (not shown) that extend through the four elongated mounting holes 55 of the strap 54.

With a door offset measuring approximately 1⅝ inch the installer selects a hinge with the pivot pin 45 is mounted within the third mounting hole 28 of the hinge flange 18. The first cam follower 50, shown in FIG. 4, is then journalled onto the pivot pin 45 and lowered into a position wherein the cam follower mounting post 38 resides within the first and second mounting holes 26 and 27 and the seating plate 34 is nested within the cam recess 19. The strap assembly 15 is then lowered onto the pivot pin 45 and cam follower 30 so that the cam follower enters the cylindrical portion channel 58 and contacts the camming surface 37 or the cam 32. Hence, the hinge strap assembly 15 is positioned at a most outboard position (corresponding to offset position C) farthest from the door jamb.

With a door offset measuring approximately 1⅜ inch the installer selects a hinge with the pivot pin 45 is mounted within the second mounting hole 27 of the hinge flange 18. The cam follower 51, shown in FIG. 5, is then journalled onto the pivot pin 45 and lowered into a position wherein the cam follower mounting post 38 resides within the first and third mounting holes 26 and 28 and the seating plate 34 is nested within the cam recess 19. The strap assembly 15 is then lowered onto the pivot pin 45 and cam follower 30 so that the cam follower enters the cylindrical portion channel 58 and contacts the camming surface 37 of the cam 32. Hence, the hinge strap assembly 15 is positioned at a middle position (corresponding to offset position B) from the door jamb.

With a door offset measuring approximately 1⅛ inch the installer selects a hinge with the pivot pin 45 is mounted within the first mounting hole 26 of the hinge. The cam follower 51, shown in FIG. 6, is then journalled onto the pivot pin 45 and lowered into a position wherein the cam follower mounting post 38 resides within the second and third mounting holes 27 and 28 and the seating plate 34 is nested within the cam recess 19. The strap assembly 15 is then lowered onto the pivot pin 45 and cam follower 30 so that the cam follower enters the cylindrical portion channel 58 and contacts the camming surface 37 of the cam 32. Hence, the hinge strap assembly 15 is positioned at an inboard position (corresponding to offset position A) closest to the door jamb.

The pivoting of the strap assembly 15 relative to the mounting flange assembly 12 causes the conventional rising of the strap assembly as the cam 32 rides upon the underlying cam follower 30.

It should be understood that the upper portion of the cam is not required to be hexagonal in shape and may be of any shaped which aids in preventing relative rotation between the cam and its corresponding channel, i.e., it may be oval, any polygonal shape, or any other non-round shape. Preferably, the cam has regular polygon exterior configuration wherein all sides and angles are equal, such as the octagonal shape shown in the preferred embodiment.

It should be understood that the terms cam and cam follower may be used interchangeably, as each simply includes a sloping surface configured to ride upon the other's sloping surface. It should also be understood that the present invention may be used in a hinge which is not a riser type hinge having a cam and cam follower, and therefore, the hinge utilizes flat bushings or bearings rather than the sloped cam and cam follower, i.e., the difference is only that the camming surfaces of the cam and cam follower are flat rather than being sloped to create the rising of the strap upon pivoting. Thus, the terms cam and cam follower, as used herein and especially within the claims, may also include such non-rising, flat bearings or bearing surfaces.

While this invention has been described in detail with particular reference to the preferred embodiment thereof and the best mode of practicing same, it will be understood that variations and modifications can be effected within the spirit and scope of the invention as described herein above and as set forth in the appended claims.

The invention claimed is:

1. An offset adjustable hinge comprising, a mounting flange assembly having a mounting plate and a flange extending from said mounting plate, said flange having a top surface, a cam recess extending from said top surface, and a plurality of pivot pin mounting holes extending into said flange from said cam recess, a strap assembly, and a cam assembly pivotally coupling said strap assembly to said mounting flange assembly, said cam assembly including a cam follower configured to be received within said cam recess, a cam coupled to said strap assembly and configured to engage said cam follower, and a pivot pin configured to be mounted within one said pivot pin mounting hole and extending through said cam follower and cam, whereby the offset of the hinge is determined by which pivot pin mounting hole within which the pivot pin is positioned.

2. The offset adjustable hinge of claim 1 wherein said plurality of pivot pin mounting holes are aligned generally linearly and generally perpendicular to said mounting plate.

3. The offset adjustable hinge of claim 1 wherein said cam follower includes a mounting post configured to be received within at least one said pivot pin mounting hole which is not occupied by said pivot pin.

4. The offset adjustable hinge of claim 1 wherein said cam follower includes a seating plate configured to nest within said cam recess and a mounting post configured to be received within at least one said pivot pin mounting hole which is not occupied by said pivot pin.

5. The offset adjustable hinge of claim 1 wherein said plurality of holes are contiguous.

6. An offset adjustable hinge comprising, a mounting flange assembly having a mounting plate and a flange extending from said mounting plate, said flange having a top surface, a cam recess extending from said top surface, and at least a first pivot pin mounting hole and a second pivot pin mounting hole extending into said flange from said cam recess, a strap assembly, and a cam assembly pivotally coupling said strap assembly to said mounting flange assembly, said cam assembly including a pivot pin configured to be mounted within said first or second pivot pin mounting hole, a first cam follower configured to be received within said cam recess when said pivot pin is mounted within said first pivot pin mounting hole and extending through said first cam follower, and a second cam follower configured to be received within said cam recess when said pivot pin is mounted within said second pivot pin mounting hole and extending through said second cam follower, and a cam coupled to said strap assembly and configured to engage said cam follower, whereby the offset of the hinge is determined by which pivot pin mounting hole within which the pivot pin is positioned.

7. The offset adjustable hinge of claim 6 wherein said first and second pivot pin mounting holes are aligned generally linearly and generally perpendicular to said mounting plate.

8. The offset adjustable hinge of claim 6 wherein said first cam follower includes a mounting post configured to be received within said second pivot pin mounting hole.

9. The offset adjustable hinge of claim 6 wherein said second cam follower includes a mounting post configured to be received within said first pivot pin mounting hole.

10. The offset adjustable hinge of claim 6 wherein said first cam follower includes a seating plate configured to nest within said cam recess and a mounting post configured to be received within said second pivot pin mounting hole.

11. The offset adjustable hinge of claim 6 wherein said second cam follower includes a seating plate configured to nest within said cam recess and a mounting post configured to be received within said first pivot pin mounting hole.

12. The offset adjustable hinge of claim 6 further comprising a third pivot pin mounting hole configured to receive said pivot pin, and a third cam follower configured to be received within said cam recess with said pivot pin mounted within said third pivot pin mounting hole.

13. The offset adjustable hinge of claim 12 wherein said third cam follower includes a mounting post configured to be received within said first and second pivot pin mounting holes.

14. The offset adjustable hinge of claim 12 wherein said first cam follower includes a mounting post configured to be received within said second and third pivot pin mounting holes.

15. The offset adjustable hinge of claim 12 wherein said second cam follower includes a mounting post configured to be received within said first and third pivot pin mounting holes.

16. The offset adjustable hinge of claim 6 wherein said pivot pin mounting holes are contiguous.

* * * * *